United States Patent [19]

Tetschner

[11] Patent Number: 4,620,526

[45] Date of Patent: Nov. 4, 1986

[54] STOVE TOP ATTACHMENT FOR MOBILE VEHICLES

[76] Inventor: Allen M. Tetschner, 622 E. Loucks St., Sheridan, Wyo. 82801

[21] Appl. No.: 658,785

[22] Filed: Oct. 9, 1984

[51] Int. Cl.[4] ..... F24C 1/00

[52] U.S. Cl. ..... 126/56; 126/24; 126/211; 126/214 D

[58] Field of Search ..... 126/24, 56, 211, 214 A, 126/214 R, 214 D, 42

[56] References Cited

U.S. PATENT DOCUMENTS

| | | | |
|---|---|---|---|
| 1,370,113 | 3/1921 | Janusonis | 126/24 |
| 1,638,770 | 8/1927 | Jones | 126/211 |
| 2,161,496 | 6/1939 | Wolcott | 126/214 R |
| 2,196,943 | 4/1940 | Safrit | 126/214 D |
| 3,960,134 | 6/1976 | Scott | 126/24 |

*Primary Examiner*—James C. Yeung

*Attorney, Agent, or Firm*—Paul H. Gallagher

[57] ABSTRACT

A panel that fits on the top of a stove in a mobile vehicle. The panel has holes registering with the burners in the stove, for receiving the cooking utensils placed on the burners. Confining upstanding flanges surround the holes to retain the cooking utensils against sliding movements in the movements of the vehicle. The panel is held in place by peripheral downturned flanges engaging the side surfaces of the stove, or by engagement of the panel with wall elements at the sides of the stove.

1 Claim, 6 Drawing Figures

STOVE TOP ATTACHMENT FOR MOBILE VEHICLES

FIELD OF THE INVENTION

The invention resides in the field of mobile vehicles. Such vehicles usually include various appurtenances and appliances including a stove, and some of them cannot be used while the vehicle is in motion, but only while it is stationary. In the case of the stove, any cooking utensils placed thereon would easily slide off in the travelling movements of the vehicle.

OBJECTS OF THE INVENTION

A broad object of the invention is to provide a novel means for retaining utensils on a stove in a mobile vehicle while the vehicle is in motion.

Another object is to provide such a means having the following features and advantages:

1. It is extremely simple whereby to enable it to be easily and quickly applied to and removed from the stove.
2. Its simplicity includes (a) small dimensions whereby to enable it to be easily stored when not in use, (b) low cost of manufacture, and (c) pleasing appearance.

DESCRIPTION OF A PREFERRED EMBODIMENT

Figure 1:
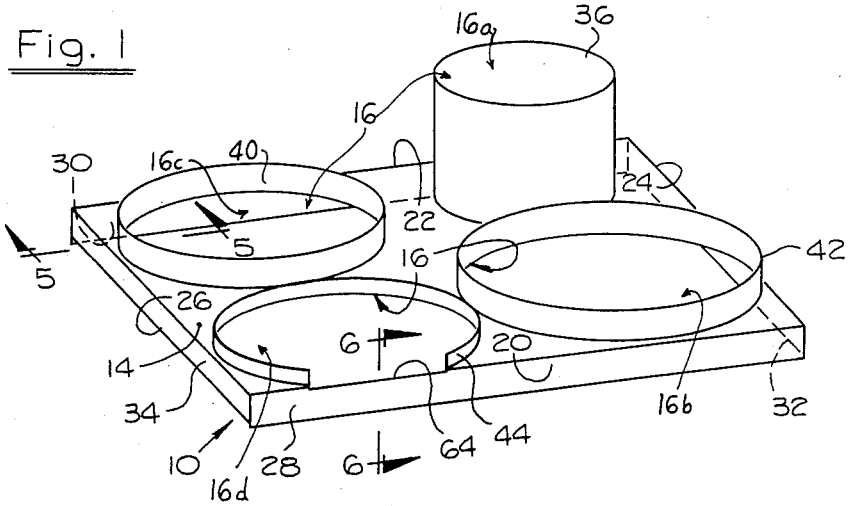
FIG. 1 is a perspective view of the attachment embodying the features of the present invention.
Figure 2:
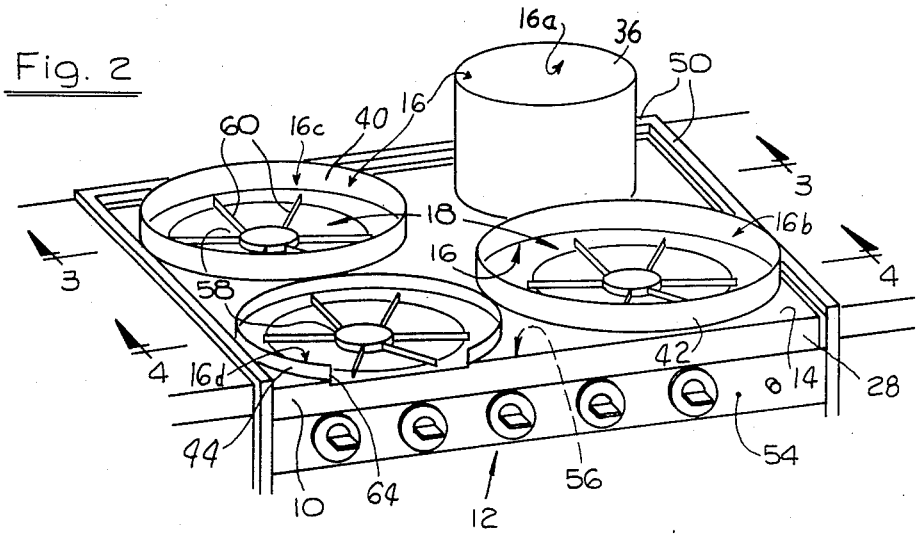
FIG. 2 is a perspective view of the attachment applied to a stove.

Referring in detail to the drawings, FIG. 1 shows the attachment as a whole, indicated at 10, and FIG. 2 is a perspective view, showing a fragment of the stove 20 to which it is attached, and including the attachment.

The attachment 10 is preferably of stainless steel and includes a main panel 14 having a plurality of holes 16, in this case four, to register with the burners 18 of the stove. The panel 14 has a front edge 20, a rear edge 22, a right edge 24, and a left edge 26. The panel is provided with downturned flanges on all of its edges, including flanges 28, 30 at the front and rear, and flanges 32, 34 at the right and left edges respectively. The front and rear flanges may be about 1 and ⅛ inch deep, while the side flanges may be of lesser depth. These dimensions are only examples.

Surrounding the holes 16 are upstanding flanges for retaining kitchen utensils in place, that are set in the holes, on the burners. For example, the hole **16*a* at the upper right of FIG. 1, is preferably of smaller diameter, such, for example, as 6", and has a flange 36 of substantial height, such as 4", for receiving a correspondingly shaped utensil, such as the coffee pot 38 shown in FIG. 3. The other holes 16 are provided with flanges 40, 42, 44 of lesser height, and if desired these may be of various heights. For example, the flanges 40, 42 may be about one inch in height, while the flange 44** may be of lesser height for accommodating different kinds of utensils.

Figure 5:
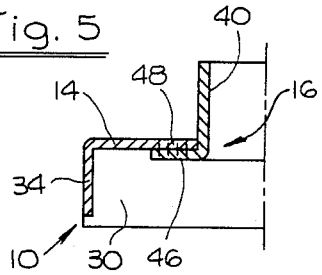
FIG. 5 is a sectional view taken at line 5—5 of FIG. 1.

The upstanding flanges may be secured to the panel 14 in any suitable manner, such as represented in FIG. 5 where the flange has an out-turned edge 46 fitted to the panel and spot welded thereto as indicated at 48. The holes **16*a*, 16*b* and 16*c* may be of different diameters, for accommodating utensils of different corresponding sizes and the hole 16*d* may be positioned as being projected outwardly beyond the edge of the panel. The panel is applied to the stove 12 as indicated in FIG. 2. The stove is of standard and well known construction used in mobile vehicles. It is, of course, confined in place and is often surrounded on three sides by other construction elements indicated at 50, but there is a space between the stove proper and these elements 50 as indicated at 52 in FIGS. 3 and 4. For convenience in reference to the stove, it has a front surface 54, and a top surface 56, and burners 58 of the usual kind, which usually include radiating bars 60 supporting the utensils. The holes 16** are positioned for registering with the burners when the attachment is applied to the stove.

Figure 3:
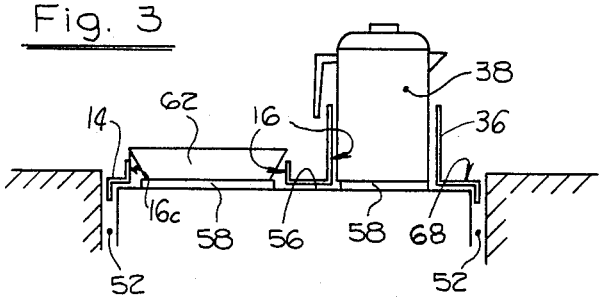
FIG. 3 is a sectional view taken on line 3—3 of FIG. 2, with certain kitchen utensils fitted in the attachment.
Figure 4:
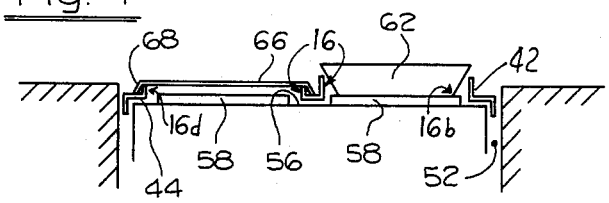
FIG. 4 is a sectional view taken at line 4—4 of FIG. 2, showing certain kitchen utensils fitted in the attachment.
Figure 6:
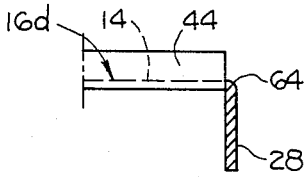
FIG. 6 is a sectional view taken at line 6—6 of FIG. 1.

FIGS. 3 and 4 show the various elements, including the attachment, in semi-diagrammatic form. The panel 14 extends across the top of the stove, but may not rest completely on the top surface 56, depending on the shape of the particular stove, but even though it may be slightly spaced therefrom, it is held in stable position at the edges of the stove as indicated at 68. Then in placing the utensils in place, the coffee pot 38 is put in place as indicated above, and then another utensil indicated at 62, which may be a skillet, for example, is placed in another hole **16*c***.

The burners of the stove are usually of different diameters, and the different diameters of the holes 16 accommodate such burners, and particularly, attention is called to the burner at the lower left, and the hole **16*d*. As indicated above, this hole is of relatively great diameter, such that it would be projected forwardly beyond the edge of the panel, and to accommodate this dimension, the flange 44 may be cut out at the front as indicated at 64. However, the flange extends more than half way around the hole. The flange 44, as indicated above, being relatively low (FIG. 4) enables a griddle type utensil 66 to be accommodated. This griddle is usually shallower and has a surrounding edge 68 and is put in position by setting it on the burner and the edge 68** overlies the flange, and the utensil is held in position in that manner.

Thus the device enables the stove to be used while the vehicle is in motion, retaining all of the utensils in proper position.

The invention is of such scope as to cover the utilization of the construction elements 50 for retaining the panel in place, but preferably the peripheral flanges engaging the side edges of the stove are relied on for that purpose. The attachment thereby becomes a snap-on device, which can be readily and easily put in place and lifted off. The attachment is unitary, and effectively integral, and very light in weight. This lightness in weight enables it to be handled readily, and its compact size enables it is to be stored in a convenient place when not in use, or when the vehicle is parked and not in movement.

While the front flange 28 is not essential for retaining the attachment against horizontal movement, it is an advantage in solidifying the overall construction, and for appearance sake.

I claim:

1. A stove top attachment for a stove in a mobile vehicle having a top surface with burners exposed therethrough and adapted for placement thereon of cooking utensils on the burners, comprising a panel adapted to be placed on the top of the stove, the panel being of stamped sheet metal having a top element of essentially planar shape extending to the side limits of the panel, and downwardly extending integral flanges at its side edges engageable with the side walls of the stove, when the panel is on the stove, to stabilize the panel, the top element having holes of different sizes therethrough in register with the burners when the panel is in position on the stove, the panel including upstanding flanges surrounding the holes, operable for retaining utensils in the holes, the upstanding flanges being separate from the top element and secured to the top element, and of different heights, one of the holes being adjacent the periphery of the top element with the radius of the hole projected beyond that periphery, but the hole being confined within that periphery and the downwardly extending flange at that location being continuous across the projection of the hole, and the upstanding flange being cut out correspondingly to the hole but extending more than 180°.

* * * * *